US010611175B2

(12) United States Patent
Falter

(10) Patent No.: US 10,611,175 B2
(45) Date of Patent: Apr. 7, 2020

(54) METHOD FOR PRINTING ON A BODY BY USING INKJET PRINTING

(71) Applicant: HEIDELBERGER DRUCKMASCHINEN AG, Heidelberg (DE)

(72) Inventor: Silas Falter, Heddesbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/427,431

(22) Filed: May 31, 2019

(65) Prior Publication Data

US 2019/0389228 A1 Dec. 26, 2019

(30) Foreign Application Priority Data

Jun. 21, 2018 (DE) ..... 10 2018 210 113

(51) Int. Cl.
*B41J 3/407* (2006.01)
*B41J 2/14* (2006.01)
*B41J 11/00* (2006.01)

(52) U.S. Cl.
CPC ..... *B41J 3/4073* (2013.01); *B41J 2/14* (2013.01); *B41J 11/002* (2013.01)

(58) Field of Classification Search
CPC ..... B41J 2/1433; B41J 2/161; B41J 2/1623; B41J 2202/00; B41J 2202/03; B41J 2/14201; B41J 2/045; B41J 2/01; B41J 2/211; B41J 2/17; B41J 2/17593; B41J 2/2107; B41J 2/1755; B41J 2/2114; B41J 2/2117; B41J 2/2056; B41J 2/21; B41J 2/0057; B41J 3/60; B41J 2002/012; B41J 2/04598; B41J 2/04588; B41J 2/04595; B41J 2/04586; B41J 2/14274; B41J 11/0015; B41J 11/002; C09D 11/36; C09D 11/40; C09D 11/30; C09D 11/38; C09D 11/32; C09D 11/322; C09D 11/324; C09D 11/328; C09D 11/101; C09D 11/102; C09D 11/005; C09D 11/54; C09D 11/52; B41M 5/0011; B41M 5/0017; B41M 5/0047; B41M 7/00; B41M 7/0072; B41M 5/52; B41M 5/5218
See application file for complete search history.

(56) References Cited

U.S. PATENT DOCUMENTS 7,137,696 B2 * 11/2006 Siegel ..... B41F 23/0409 347/102
8,882,242 B2 11/2014 Beier et al.
9,079,427 B2 7/2015 Duffield
(Continued)

FOREIGN PATENT DOCUMENTS

DE 102009004877 A1 7/2010
DE 102012006370 A1 10/2013
(Continued)

*Primary Examiner* — Manish S Shah
(74) *Attorney, Agent, or Firm* — Laurence A. Greenberg; Werner H. Stemer; Ralph E. Locher

(57) ABSTRACT

A method for printing tracks on bodies by using inkjet printing provides printed images with a homogeneous appearance on the bodies, in particular when printing large single-color areas. The homogeneous appearance is obtained by reducing the intensity of the UV radiation from at least one inkjet print head when pinning in track connection regions.

11 Claims, 2 Drawing Sheets

(56) References Cited

U.S. PATENT DOCUMENTS

| | | | | |
|---|---|---|---|---|
| 9,266,354 | B2 | 2/2016 | Moehringer et al. | |
| 9,746,573 | B1 | 8/2017 | Olsson et al. | |
| 9,802,424 | B2 | 10/2017 | Sonnauer | |
| 2003/0112307 | A1* | 6/2003 | Maeda | C08G 59/68 347/102 |
| 2006/0230969 | A1* | 10/2006 | Vosahlo | B41J 11/002 101/488 |
| 2007/0052790 | A1* | 3/2007 | Aoai | C09D 11/101 347/224 |
| 2007/0115335 | A1 | 5/2007 | Vosahlo et al. | |
| 2008/0174648 | A1* | 7/2008 | Nakano | B41J 11/002 347/102 |
| 2013/0286060 | A1 | 10/2013 | Duffield | |
| 2015/0138275 | A1 | 5/2015 | Noell | |

FOREIGN PATENT DOCUMENTS

| | | | |
|---|---|---|---|
| DE | 102014221103 | A1 | 12/2014 |
| DE | 102015203798 | A1 | 10/2015 |
| DE | 102014012395 | A1 | 2/2016 |
| EP | 3023253 | A1 | 5/2016 |
| WO | 2004002746 | A1 | 1/2004 |
| WO | 2013165394 | A1 | 11/2013 |

* cited by examiner

METHOD FOR PRINTING ON A BODY BY USING INKJET PRINTING

CROSS-REFERENCE TO RELATED APPLICATION

This application claims the priority, under 35 U.S.C. § 119, of German Patent Application DE 10 2018 210 113.2, filed Jun. 21, 2018; the prior application is herewith incorporated by reference in its entirety.

BACKGROUND OF THE INVENTION

Field of the Invention

The invention relates to a method for printing on bodies by using inkjet printing, in which printed images with a homogeneous appearance are obtained on the bodies.

In order to print on bodies, in particular spherical bodies such as, e.g., soccer balls, motorbike helmets and the like, by inkjet printing, the printed images to be printed onto the bodies are not printed in a single iteration due to the comparatively small size of conventional inkjet print heads used in known procedures. Instead, the desired printed image is decomposed into individual tracks, paths or webs and the individual tracks are printed onto the body in succession by using the inkjet print head and are cured in succession by radiation, usually UV radiation. A printing machine suitable for that purpose is described in German Patent Application DE 10 2015 203 798 A1, corresponding to U.S. Pat. No. 9,266,354, for example.

A particular challenge when printing bodies in that manner lies in obtaining a homogeneous printed image on the body that, to the naked eye, is not clearly composed of a plurality of tracks. That problem is particularly pronounced if large areas of the same color are printed onto the body.

The prior art has described various approaches to meeting those challenges.

European Patent Application EP 3 023 253 A1, corresponding to U.S. Pat. No. 9,802,424, describes a method and an apparatus for inkjet printing on containers. Partial prints which overlap in combing fashion in a connection region are used for the purpose of displaying relatively large printed images on the containers.

International Publication WO 2013/165394 A1, corresponding to U.S. Pat. No. 9,079,427, describes an inkjet printing method in which the UV power varies according to the printing and, for example, increases linearly. In that case, the UV power is varied uniformly over the entire width of the printed tracks.

The methods used in the prior art are substantially restricted to geometric optimizations of the boundary region of adjacent printing tracks or the optimization of the UV radiation power over the entire width of the printing track in order to reduce the conspicuousness of the track connection. The methods described in the prior art are not satisfactory in terms of optical results.

SUMMARY OF THE INVENTION

It is accordingly an object of the invention to provide a method for printing on a body by using inkjet printing, which overcomes the hereinafore-mentioned disadvantages of the heretofore-known methods of this general type and which renders it possible to further reduce the conspicuousness of the track connection and hence further increase the optical homogeneity of the printed image.

A surprising discovery was that a very homogeneous printed image is obtained if the pinning power, i.e., the intensity of the employed UV radiation, is set in such a way for each track it is reduced in edge regions of the track.

With the foregoing and other objects in view there is provided, in accordance with the invention, a method for printing a body by inkjet printing, comprising the following steps:

i) providing a body and printing the body with a printed image by using at least one inkjet print head, in which the printed image is composed of at least two tracks and each track has an inner core region and two outer edge regions, and the at least two tracks are disposed in such a way that the outer edge regions of adjacent tracks adjoin one another or partly overlap, and ii) irradiating the tracks produced in step i) with UV radiation by using a UV radiation source, in which the intensity of the UV radiation used during the irradiation step ii) reduces from the inner core region to the outer edges of the outer edge regions of the tracks produced in step i).

A printed image within the scope of the present invention is understood to mean the overriding image motif, which is composed of the at least two printed tracks.

Preferably, an ink that can be cured by using UV radiation is used in the method according to the invention when printing on the body. There are no particular restrictions placed on the selection of inks. In principle, any ink known to a person skilled in the art that can be used for printing and UV curing in a printing machine can be used. The inks may be colored or colorless, with colored inks being preferred.

According to the invention, at least two tracks are produced on the body by using at least one inkjet print head, with the at least two tracks subsequently being cured by using a UV radiation source. In a preferred embodiment, the at least one inkjet print head traverses a path over the body for producing the at least two tracks and the UV radiation source follows this path in order to effectuate the curing of the ink on the body sometime after the application of the ink on the body. In a particularly preferred embodiment, the body traverses a path under the at least one inkjet print head when producing the at least two tracks by using the at least one inkjet print head and the UV radiation source follows this path.

In a preferred embodiment of the method according to the invention, the intensity of the UV radiation in the case of the irradiation carried out in step ii) is set in such a way that the UV radiation only leads to partial curing of the tracks produced in step i). Subsequently, the partly cured tracks are fully cured by irradiation with higher intensity UV radiation in a step iii) that follows step ii).

According to the invention, the intensity of the UV radiation used when irradiating in step ii) reduces from the inner core region to the outer edges of the outer edge regions of the tracks produced in step i). Preferably, the intensity of the UV radiation is virtually constant over the entire width of the inner core region of a track and then decreases from the inner edge of the respective outer edge region to the outer edge of the respective outer edge region.

In a preferred embodiment, the intensity of the UV radiation used when irradiating in step ii) reduces down to an intensity of zero from the inner core regions to the outer edges of the outer edge regions of the tracks produced in step i).

The drop in intensity of the UV radiation from the inner core region to the outer edge of a respective outer edge region may follow a linear, exponential or any other curve. An approximately exponential decrease in the intensity of the UV radiation from the inner core region to the outer edge of a respective outer edge region is preferred. Preferably, the approximately exponential decrease in the intensity of the UV radiation is effectuated to an intensity of zero at the outer edge of the outer edge region of a track.

According to the invention, the tracks produced in step i) are irradiated with UV radiation in step ii). In a preferred embodiment, the intensity of the UV radiation in the inner core region lies at no more than 5000 mW/cm$^2$, preferably at no more than 3000 mW/cm$^2$ and particularly preferably at no more than 2000 mW/cm$^2$. In a preferred embodiment, the intensity of the UV radiation used when irradiating in step ii) lies in the range between 0 and 5000 mW/cm$^2$, preferably in the range between 0 and 3000 mW/cm$^2$, particularly preferably in the range between 0 and 2000 mW/cm$^2$, over the entire width of the track.

According to the invention, the printed image is composed of at least two tracks, with the at least two tracks being disposed in such a way that the outer edge regions of adjacent tracks adjoin one another or partly overlap. Adjacent tracks can be disposed parallel to one another or in any other way, for example obliquely in relation to one another. In the case of a parallel configuration of the adjacent tracks with respect to one another, they can adjoin one another, i.e., be disposed next to one another without interstices and without overlap, or they may partly overlap. If the adjacent tracks are disposed obliquely in relation to one another, they overlap at least in part. In a preferred embodiment, the at least two tracks are disposed parallel to one another. In a particularly preferred embodiment, the at least two tracks are disposed parallel to one another and partly overlap.

The width of the tracks produced in step i) is not particularly restricted and substantially only depends on the printing width of the employed inkjet print head. In a preferred embodiment, the width of a track produced in step i) lies in the range of between 0.5 and 10 cm, preferably between 1 and 8 cm.

Every track produced on the body has an inner core region and two outer edge regions which, together, yield the overall width of the respective track. It is preferable for the two outer edge regions of a track to have the same width. Preferably, the ratio of the width of the inner core region to the width of an outer edge region of a track lies in the range between 1:5000 and 5000:1, particularly preferably in the range between 1:1000 and 1000:1, very particularly preferably in the range between 1:500 and 500:1 and specifically in the range between 1:100 and 100:1.

In the method according to the invention, the UV radiation reduces from the inner core region to the outer edges of the outer edge regions of the irradiated tracks. Preferably, this is achieved by at least one of the following measures:

a) partial shielding of the UV radiation source, in particular by using a stop;

b) partial shielding of the body, in particular by using a stop;

c) changing the position of body and UV radiation source with respect to one another, in particular the angle with respect to one another;

d) controlling the local power of the UV radiation source.

In the preferred case d), the UV radiation source can be an LED strip, in which UV-radiation-emitting LED emitters are disposed next to one another in a strip. In order to achieve a decrease in the UV intensity toward the edge, the radiation power of the outer LED emitters can be reduced in comparison with the inner LED emitters, for example, in the case of such an LED strip.

In the method according to the invention, bodies to be printed are preferably those that have an at least partly arched structure and, in particular, have a spherical, i.e., elliptical or ball-shaped form. Examples of suitable bodies to be printed are balls, for example soccer balls, handballs or basketballs, helmets, for example motorbike helmets, racing driver helmets or bicycle helmets, bottles, cans and the like.

In principle, all UV radiation sources known to a person skilled in the art can be used as a UV radiation source in the method according to the invention, for example UV light-emitting diodes (LEDs), UV cold cathode tubes, UV lasers, quartz lamps or mercury vapor lamps.

Other features which are considered as characteristic for the invention are set forth in the appended claims.

Although the invention is illustrated and described herein as embodied in a method for printing on a body by using inkjet printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
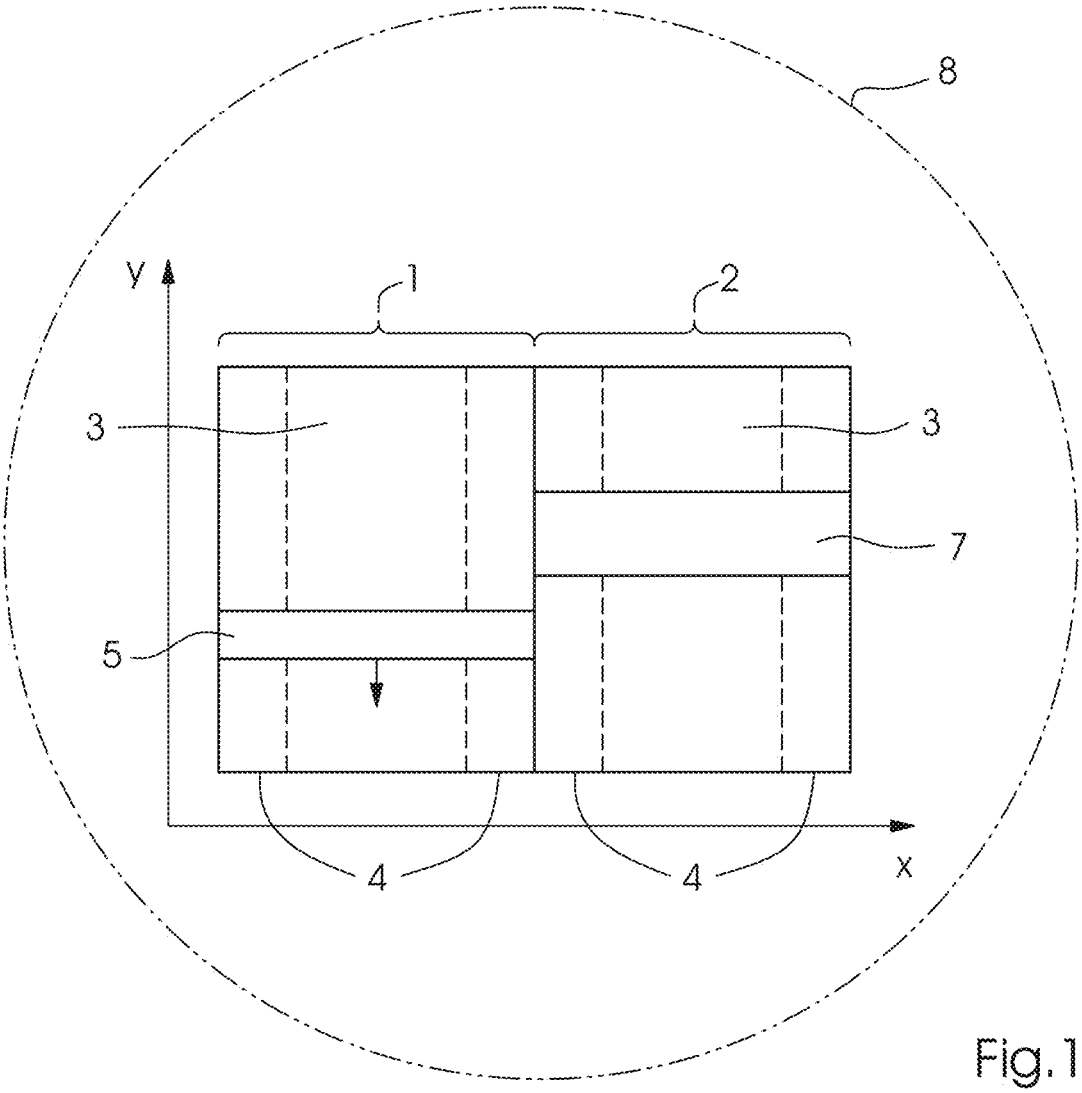
FIGS. 1-3 are top-plan views of paths, webs or tracks of an image printed on a body and having a core region and outer regions and being irradiated with UV radiation according to the invention.

Referring now in detail to the figures of the drawings and first, particularly, to FIG. 1 thereof, there is seen a diagrammatic illustration of two paths, webs or tracks 1, 2 of an image printed on a body and lying in parallel next to one another, directly adjoin one another and each have an inner core region 3 and two outer edge regions 4. A UV radiation source 5, which may have non-illustrated UV LEDs disposed next to one another, for example, is also illustrated. The first track 1 is produced by virtue of the body 8 being displaced from top to bottom (along the y-axis) under a stationary inkjet print head 7 in a first step and the track produced in this manner then being cured (pinning) with UV radiation by using the UV radiation source 5 in a second step. In this case, the UV radiation source 5 follows the trajectory of the track and therefore, i.e., it is likewise displaced from top to bottom (along the y-axis, as symbolized by the arrow on the UV radiation source). Subsequently, the second track 2 is produced in the same way and cured by irradiation with the UV radiation source 5.

Figure 2:
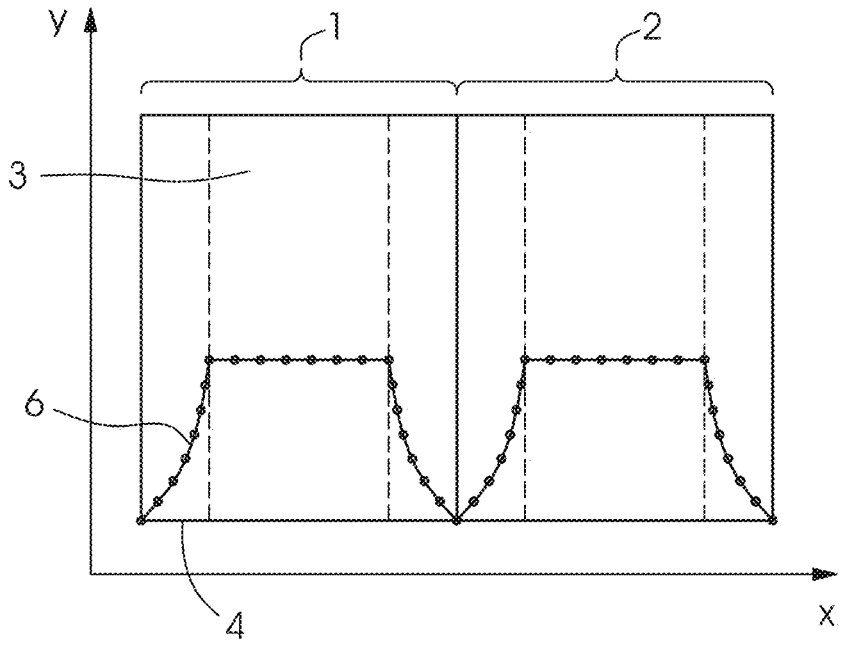

FIG. 2 shows the two tracks 1, 2 of FIG. 1, lying in parallel next to one another, with the spatial directions x and y and, additionally in schematic fashion, a local distribution of the applied UV radiation intensity, which can also be referred to as UV power, on both tracks 1, 2 (shown by lines with dots having an increasing UV radiation intensity in the y-direction). In the inner core regions 3 of the tracks 1, 2, the UV radiation intensity is virtually constant and at a maximum level over the entire width of the respective inner core region. In the outer edge regions 4, the UV radiation intensity reduces from the high level of the inner core region 3 down to a UV radiation intensity of zero at the outer edges of the outer edge regions 4. The drop in the UV radiation intensity from the inner core region 3 to an outer edge of an outer edge region 4 is also referred to as a flank 6.

Figure 3:
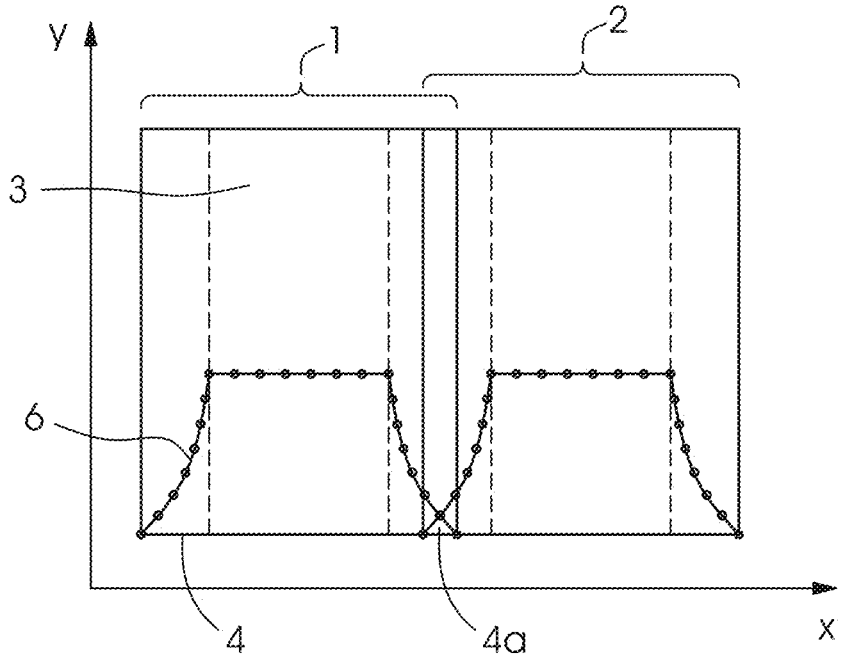

FIG. 3 shows a principle similar to that shown in FIG. 2, with the two tracks 1, 2 lying in parallel next to one another having a partly overlapping outer edge region 4*a* of their respective outer edge regions 4. Accordingly, there is also irradiation with the non-illustrated UV radiation source in such a way that the areas irradiated by UV radiation in the outer edge regions of the tracks partly overlap (as indicated by lines with dots).

LIST OF REFERENCE SIGNS

1 First track
2 Second track
3 Inner core region
4 Outer edge region
4*a* Overlapping outer edge regions
5 UV radiation source
6 Drop in the curve of the UV radiation intensity (flank)
7 Inkjet print head
8 Body
x Spatial direction x
y Spatial direction y

The invention claimed is:

1. A method for printing on a body by using inkjet printing, the method comprising the following steps:

i) using at least one inkjet print head to print an image composed of at least two tracks on a body, each of the tracks having an inner core region and two outer edge regions, and the outer edge regions of adjacent tracks adjoining or partly overlapping one another; and ii) using a UV radiation source to irradiate the tracks produced in step i) with UV radiation, and reducing an intensity of the UV radiation from the inner core region to outer edges of the outer edge regions of the tracks produced in step i) during the irradiating.

2. The method according to claim 1, which further comprises using an ink to be cured by UV radiation when printing on the body by inkjet printing.

3. The method according to claim 1, which further comprises moving the body along a path under the at least one inkjet print head when using the at least one inkjet print head to produce the at least two tracks, and moving the UV radiation source to follow the path.

4. The method according to claim 1, which further comprises:

only partially curing the tracks produced in step i) with the irradiation carried out in step ii); and iii) fully curing the partly cured tracks by irradiation with UV radiation following step ii).

5. The method according to claim 1, which further comprises carrying out the step of reducing the intensity of the UV radiation in step ii) by reducing the intensity of the UV radiation down to an intensity of zero from the inner core regions to the outer edges of the outer edge regions of the tracks produced in step i).

6. The method according to claim 1, which further comprises using an intensity of the UV radiation in a range between 0 and 5000 $mW/cm^2$ over an entire width of the track when irradiating in step ii).

7. The method according to claim 1, which further comprises placing the at least two tracks produced in step i) parallel to one another.

8. The method according to claim 1, which further comprises providing a width of a track produced in step i) in a range between 0.5 and 10 cm.

9. The method according to claim 1, which further comprises providing a ratio of a width of the inner core region to a width of an outer edge region of a track in a range between 1:500 and 500:1.

10. The method according to claim 1, which further comprises obtaining the reduction in the intensity of the UV radiation from the inner core region to the outer edges of the outer edge regions of the irradiated tracks by at least one of:

a) partially shielding the UV radiation source;

b) partially shielding the body;

c) changing a position of the body and the UV radiation source relative to one another; or d) controlling a local power of the UV radiation source.

11. The method according to claim 10, which further comprises partially shielding the UV radiation source by using a stop, partially shielding the body by using a stop, and changing the position of the body and the UV radiation source relative to one another by changing an angle of the body and the UV radiation source relative to one another.

* * * * *